US005259133A

United States Patent [19]

Burtch

[11] Patent Number: 5,259,133

[45] Date of Patent: Nov. 9, 1993

[54] POP-UP DISPLAY DEVICE

[76] Inventor: Ronald P. Burtch, 122 Oak Meadow Blvd., West Hill, Ontario, Canada, M1E 4G7

[21] Appl. No.: 864,608

[22] Filed: Apr. 7, 1992

[51] Int. Cl.[5] ..... G09F 1/09

[52] U.S. Cl. ..... 40/124.1; 40/488; 40/491

[58] Field of Search ..... 40/124.1, 488, 491; 446/148, 151

[56] References Cited

U.S. PATENT DOCUMENTS 658,968 2/1928 Carroll ..... 40/488

1,008,195 11/1911 Prichard ..... 40/491 X

*Primary Examiner*—Kenneth J. Dorner

*Assistant Examiner*—C. Hope Davis

*Attorney, Agent, or Firm*—Larson and Taylor

[57] ABSTRACT

A pop-up display device is erectable to provide, for example, a pop-up action figure as part of a baseball card or the like. The device comprises a flat base portion forming a support for the device and an erectable display portion disposed in a non-erected state so as to overlie the base portion and including a pop-up portion partially cut out from the erectable display portion adjacent to a central transverse fold line therein. Disposed between the erectable display portion and the base portion is a pull tab member which includes a pull tab located at one end thereof and which is secured to the erectable display portion such that a pulling force exerted on the pull tab will cause the erectable display portion to elevate from the plane of the base portion at the fold line and to thereby cause the pop-up portion to be erected so as to extend outwardly from the remainder of the erectable display portion at the fold line. A blank for making the device is also provided.

20 Claims, 2 Drawing Sheets

POP-UP DISPLAY DEVICE

FIELD OF THE INVENTION

The present invention relates to novelty items and devices such as baseball cards or cards relating to players in other sports and, more particularly, to an erectable pop-up display device which, in a non-limiting embodiment, provides a pop-up action figure of a player in addition to presenting data (e.g., a photograph and the playing records of a player) such as is normally presented on conventional sports cards.

BACKGROUND OF THE INVENTION

Baseball cards are very popular in the United States, particularly with younger baseball fans, and many of the same or other fans also collect similar cards involving other sports such as football, basketball and hockey. Such sports cards are typically flat, i.e., two dimensional, cards containing a photograph of a particular player together with identifying information on one side, and information such as the birth date, home town, team or teams played with and playing records of the player, on the other side.

As indicated above, while the invention is not limited to such an application, one aspect of the invention is concerned with providing a pop-up sports card, i.e., a card which, when deployed or erected, is three dimensional rather than flat and includes a portion which is raised up or erected from the base plane of the card. Pop-up items or devices are obviously not new per se and are, for example, often provided in children's books wherein opening of the book to a particular page and laying the book flat will cause a pop-up figure and/or scene described in the book to be erected and to thus stand up from the plane of the book. Further, patents relating to pop-up or cut-out display devices include the following: U.S. Pat. No. 3,090,144 (Malamudi); U.S. Pat. No. 4,062,138 (Warenback); U.S. Pat. No. 4,161,833 (Wagner); and U.S. Pat. No. 5,010,669 (Moran).

SUMMARY OF THE INVENTION

In accordance with one aspect of the invention, an erectable display or novelty device is provided which, in one non-limiting application, not only enables graphic material, data or other information to be presented in a manner similar to that provided by an ordinary sports card such as a baseball card but also enables, in a second mode, a pop-up action figure or the like to be erected and supported while, in addition, revealing and thus presenting further such material. This second mode substantially adds to the appeal of the card and the pop-up action figures provided can be used in playing games, e.g., entire baseball teams can be collected and used to play mock baseball games.

The display device is relatively simple yet rugged in construction and can be made out of inexpensive materials such as are used in making sports cards (e.g., cardboard). These qualities and advantages, among others, enable the invention to be used in many other different applications including the use thereof as an advertising display device or as a novelty item depicting, e.g., cartoon or other comic figures or human or animal personalities, whether fictional or real, as seen, e.g., on television or in the movies.

As explained below, a further important aspect of the invention concerns the provision of a blank for making such a display device. The blank of the invention makes highly efficient use of the material from which the blank is fabricated so that there is little waste, and also enables a display device exhibiting the advantages discussed above to be readily assembled in an effective, relatively uncomplicated manner.

In accordance with the first aspect of the invention mentioned above, a pop-up display device is provided which comprises a base or base member for supporting the device, an erectable display member, including an intermediate fold line between opposite ends thereof, which is movable between a first, rest position wherein the erectable display member lies flat over the base member and a second, deployed position wherein the erectable display member forms a tent-like construction formed by adjacent parts of the erectable display member joined at the fold line and with the intermediate fold line at the apex thereof, and an actuator member secured at one end thereof to the erectable display member for controlling movement of said erectable display member between the rest and deployed positions thereof. The erectable display member includes a pop-up portion partially cut out from one of said adjacent parts so that the pop-up portion separates from the remainder of the erectable display member at the fold line and extends outwardly from the other of the adjacent parts, in the same plane therewith, when the erectable display member is moved to the second position thereof.

Preferably, the display device comprises a U-shaped portion which overlies, and is secured to, the base member and which includes central part and parallel legs connected to the central part and forming a channel between those legs. The erectable display member includes a second fold line therein and is secured to the central part at the second fold line, and the parallel legs are disposed on opposite sides of the erectable display member so as to guide movement thereof, in the channel, between said first and second positions.

The actuator member advantageously comprises a flat strip which overlies the base portion and slides thereon and which extends laterally outwardly on at least one side thereof beneath one of the aforementioned legs so as to retain the erectable display member in said channel.

The erectable display member preferably includes a foot portion which is joined to the remainder of the erectable display member at a third fold line and which lies flat on, and slides over, the base portion during movement of the erectable display member. Advantageously, the actuator member is secured to this foot portion of the erectable display member.

In a preferred embodiment, the base member and the central part of the U-shaped portion include aligned notches forming a common recess in an outer edge of the display device and the actuator member includes a pull tab which is disposed in said common recess so that access may be had to the pull tab when the erectable display actuator member is in the first, rest position thereof.

In accordance with the second aspect of the invention mentioned hereinbefore, a blank is provided for forming a pop-up display device, the blank comprising a first, central section and second and third lateral sections formed by first and second fold lines located between the central section and the lateral sections. The central section forms a flat base of the display device when the device is assembled while one of the lateral sections includes an erectable display member, including a pop-up portion partially cut out therefrom, and is folded over, when the device is being assembled along the corresponding fold lines so as to overlie the flat base. The other of the two lateral sections includes an actuator member and has cuts therein so that the actuator member can be readily separated from the blank and can be disposed, when the display device is assembled, between the other lateral section and the flat base, with the actuator member being secured to the erectable display member.

The erectable display member of the one lateral section is preferably disposed between lateral portions of that section and is separated therefrom by cuts in the blank, and is joined at a first, transverse fold line to an end portion of that one section. The pop-up portion of the erectable display member advantageously includes a base part joined to the remainder of the erectable display member adjacent to a second, intermediate, transverse fold line. In an advantageous embodiment, the second fold line includes parts on opposite sides of the base part of the pop-up portion so that the latter is located centrally of the display. Preferably, the erectable section includes a third transverse fold line spaced from intermediate fold line on the opposite side thereof, i.e., at the opposite end thereof, from the first fold line. Advantageously, the actuator member is wider than the erectable display member and thus serves to retain the latter in place.

The other lateral section, i.e., that containing the actuator member, preferably includes an outer elongate strip separated from the actuator member by a longitudinal cut in that section and adapted to be separated completely therefrom so as to be secured to one side of the base, and a further elongate portion which is disposed adjacent to the fold line joining this section to the central section and is adapted to be folded over the base along the joining fold line and secured to the opposite side of the base from said one side.

The central section and said one section preferably include notches therein which are brought into registration to form a common recess in an edge of the display device when said one section is folded over so as to overlie the central section. The actuator member advantageously includes a pull tab formed in one end thereof which, when the display device is assembled, is disposed in the common recess.

In an advantageous embodiment, the actuator member and the erectable display member include notches therein which are brought into registration when the actuator member is secured to the erectable display member.

Other features and advantages of the invention will be set forth in, or apparent from, the following detailed description of preferred embodiments of the invention.

DESCRIPTION OF THE PREFERRED EMBODIMENTS

Figure 1:
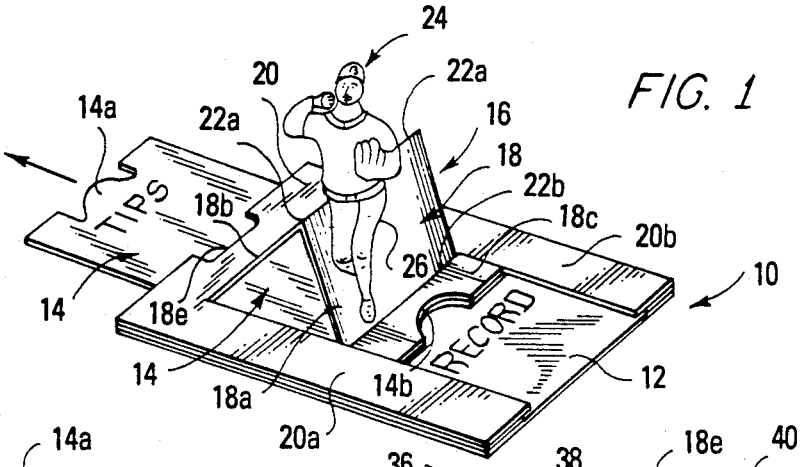
FIG. 1 is a perspective view of an erectable pop-up display device constructed in accordance with a preferred embodiment of the invention, showing the device during deployment thereof.

Referring to FIG. 1, there is shown an erectable "pop-up" novelty or display device constructed in accordance with a preferred embodiment of the invention. This device shown in FIG. 1 will be considered first to provide a general overview, and details of the construction and operation of device 10 will then be considered in connection with FIGS. 2 to 6. As mentioned above, the device of the invention, in one preferred embodiment, is in the nature of a pop-up baseball card wherein an action figure of a baseball player is provided along with, e.g., a further picture and an account or display of his or her records and any awards that have been won. As shown in FIG. 1, the novelty device of this embodiment, which is generally denoted 10 in FIG. 1, includes a underlying base portion 12 which is adapted to rest on a flat surface, a pull tab or actuator portion 14 and a pop-up display portion 16. The latter includes an erectable portion 18 that is affixed at one end to pull tab or actuator portion 14 and a guide portion 20 which is of a generally U-shaped configuration with the legs **20*a* and 20*b* of the U being affixed to the sides of base portion 12 and forming guide rails on opposite sides of erectable portion 18**.

FIG. 1 shows device 10 in the process of being erected. This is accomplished by exerting a pulling force on the free end of pull tab portion 14 thereby causing deployment of the erectable portion 18 so as to form a simple raised tent-like construction as illustrated. In particular, erectable portion 18 is caused to fold along a colinear intermediate transverse fold lines **22*a* which divide portion 18 into parts 18*a* and 18*b* located above and below the fold lines 22*a* as viewed in FIG. 1 (as is explained in more detail below), and thereby causes a cutout portion 24 to separate from the remainder of part 18*b* of erectable portion 18. This cutout portion 24 extends outwardly from the part 18*a* of erectable portion 18 above fold lines 22*a* so as to form an extension of an action FIG. 26 depicted thereon. This FIG. 26 may, e.g., be a baseball pitcher, as illustrated. A foot or base portion 18*c* is formed by a lower transverse fold line 22*b*, and mates with and slides along the upper surface of base portion 12. An upper transverse fold line, indicated at 22*c*, enables part 18*b* to pivot about the hinge or pivot axis formed thereby. When the erectable portion 18 is fully erected by pulling on the free end of the tab portion 14, the upper surface of base portion 12 is exposed and, in the example referred to above, can be used to display information such as, e.g., the pitching and/or batting record of the baseball player in question including any awards (e.g., the Cy Young award) as is indicated in FIG. 1 by the notation "RECORD." Further, the upper or top surface of pull or actuator tab portion 14 is also exposed and can be used to display other information such as, e.g., tips on pitching where the player is a pitcher as is indicated in FIG. 1 by the notation "TIPS." Further, the other side of the device 10, i.e., the opposite side of base portion 12** can, e.g., contain a photograph or other picture of the player in question such as is provided on a conventional baseball card. It will, of course, be understood that the invention is not limited to the application depicted or even to similar applications, and that other different information whether pictorial or alphanumeric can be displayed.

The nature and construction of the display or novelty device 10 can perhaps be best understood by referring to FIGS. 2 to 6 which show various steps in the assembly of the device 10 in accordance with a preferred embodiment of the invention, and thus further features and details of the device 10 of FIG. 1 will be considered below.

Figure 2:
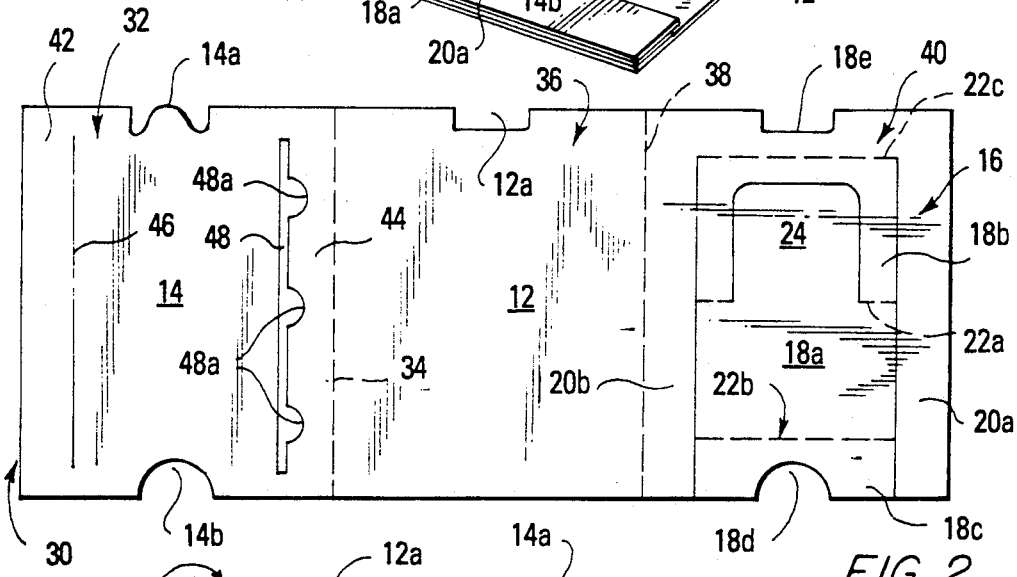
FIG. 2 is a top plan view of a blank used in the manufacture of device similar to that of FIG. 1 but with pop-up portion simplified.

As shown in FIG. 2, a blank 30 is provided which includes a pull tab or actuator section 32 that incorporates pull tab 14 or actuator portion of device 10 and is separated by a fold line 34 from a base section 36. The latter corresponds to the bottom or base layer of base portion 12 of device 10, and is separated by a further fold line 38 from an erectable section 40 corresponding to the erectable portion 18 of the device 10 of FIG. 1. It is to be understood that for purposes of ease and clarity of illustration, the pop-up portion 24 of portion 18 of FIG. 1 is shown in simplified form in FIG. 2 as a squared off shape with rounded corners. Of course, such a simplified shape or any other shape, whether simple or complex, can be employed if desired. Pop-up portion 24 is cut out from part **18*b* along three sides and forms an extension of the upper edge of part 18*a*, with fold line 22*a*** being located on opposite sides thereof as shown.

Figure 3:
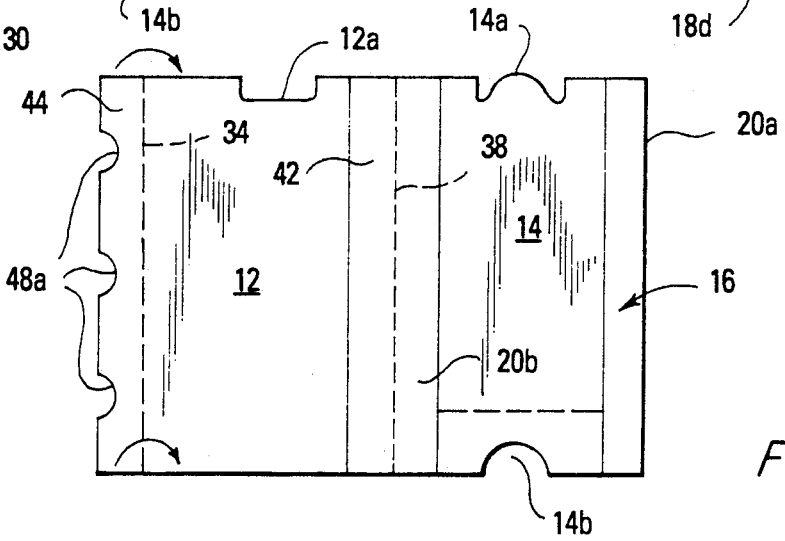
FIG. 3 is a top plan view of the blank of FIG. 2 showing a further step in the process of manufacture or assembly.
Figure 4:
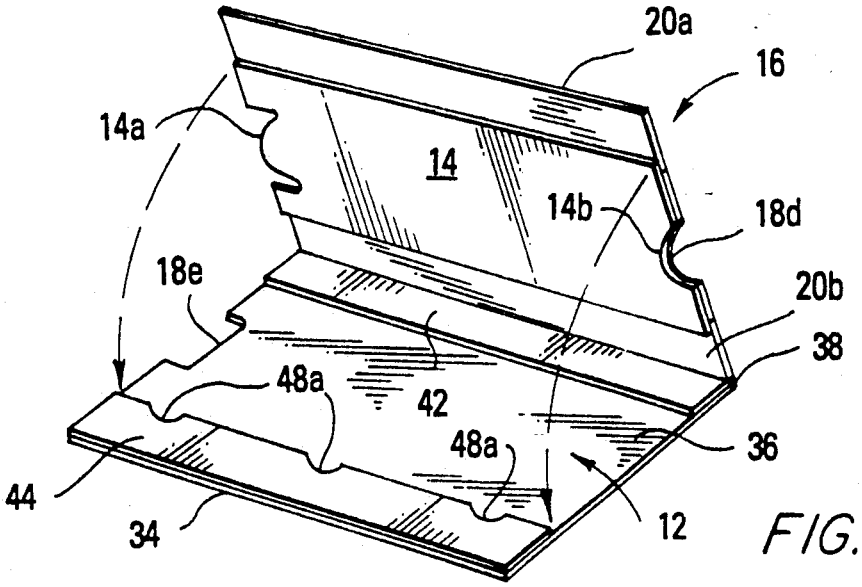
FIG. 4 is a perspective view of the blank of FIG. 2 showing another step in the process of manufacture or assembly.

Pull tab or actuator section 30 includes, in addition to pull tab or actuator (slider) portion 14, elongate laterally disposed parts 42 and 44 located on opposite sides of pull tab portion 14. Part 42 is separated from pull tab or slider portion 14 by an elongate cut (precut) 46 which extends close to the upper and lower edges of section 32. In this embodiment, part 42 is, in use, completely separated from portion 14 and affixed or secured, e.g., by gluing, to the lateral edge of base section 12 adjacent to fold line 38 as shown in FIGS. 3 and 4. Part 44 is similarly separated from pull tab portion 14 by an elongate slotlike cut 48 having semicircular recesses **48*a* spaced along the length thereof as illustrated and, in use, is folded over and affixed to the opposite lateral edge of base section 12 from part 42, as shown in FIG. 4. While thin in width, cut 48 is of sufficient width that pull tab portion is able to readily slide within guide portion 20 between parts 42 and 44. In other words, the sliver of material removed in forming cut 48 is of a width such that the overall width of the pull tab portion 14 is reduced sufficiently to provide the sliding action in question. The half circle areas 48*a* are areas where an automatic pin stripper (not shown) contacts the sliver referred to above so the sliver can be automatically stripped to form cut or slot 48**.

It is to be understood that the blank 30 is cut along the top and bottom edges to depth of the upper and lower ends of slots or cuts 46 and 48 over the entire length of these edges. These transverse cuts parallel to the two edges of blank 30 will thus completely free up pull tab portion 14 as well as part 42 and also separate part 44 from portion 14. As noted above, in use, part 44, after separation from portion 14, is folded over along fold line 34 so as to lie along the opposite edge of base section 36, as is indicated by the arrows in FIG. 3 and is shown in FIG. 4. Thus, intermediate portions or layers of the lateral guide rails **20*a* and 20*b* mentioned above are formed on opposite lateral edges of base portion 12. Base portion 12 further includes a recess or notch 12*a*** at the upper edge thereof.

As illustrated in FIGS. 2 and 3 as well as FIG. 1, pull tab or actuator portion 14 of section 32 includes a pull tab **14*a* formed by indentions in an edge at one end thereof, and a recess 14*b* formed in the edge at the opposite end thereof. As shown in FIG. 3, when portion 14 is separated from parts 42 and 44 along cuts 46 and 48, the lower end thereof as viewed in FIGS. 2 and 3, i.e., that containing recess or notch 14*b*, is affixed, e.g., by gluing, on top of erectable portion 18, and in particular, is secured to the lower base or foot portion 18*c* of the erectable portion 18 of section 40. As shown in FIG. 2, the lower edge of foot portion 18*c* includes a recess or notch 18*d* which is similar to notch 14*b*, while the opposite edge of section 40 includes a further notch 18*e* which is similar to notch 12*a* of base portion 12. Notches 14*b* and 18*d* are brought into registration when the lower edge of tab portion 14 is secured to foot portion 18*c* of erectable portion 18. Thus, portion 14 is disposed centrally of portion 16 and overlies erectable portion 18, with legs 20*a* and 20*b* of portion 16 being disposed on opposite sides of portion 14**.

After pull tab portion 14 is secured in place in the manner described above, the assembly of pull tab portion 14 and erectable portion 16 is folded over on top of base section 36 along fold line 38 as indicated in FIG. 4. When this is done, lateral edge or leg **20*a* of display portion 16 is brought into registration with, and secured to (e.g., by gluing) part 44 of base portion 12 (which was formerly part of pull tab or actuator section 32 of blank 30) and lateral edge or leg 20*b* is brought into registration with, and similarly secured to, part 42 of base portion 12 (which was also formerly part of pull tab or actuator section 32 of blank 30). It is noted that at least one of the legs 20*a* or 20*b* overlies the part 44 or 42 to which it is secured so as to capture and retain pull tab or slider portion 14** therebeneath.

Figure 5:
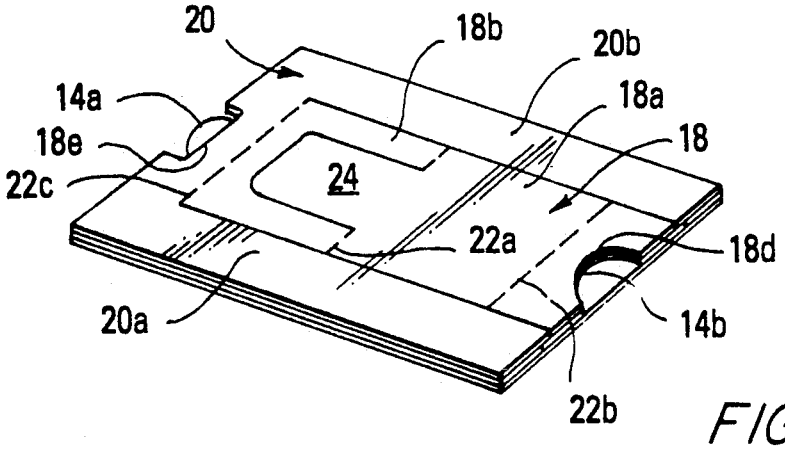
FIG. 5 is a top plan view, partially broken away, of the finished device.
Figure 6:
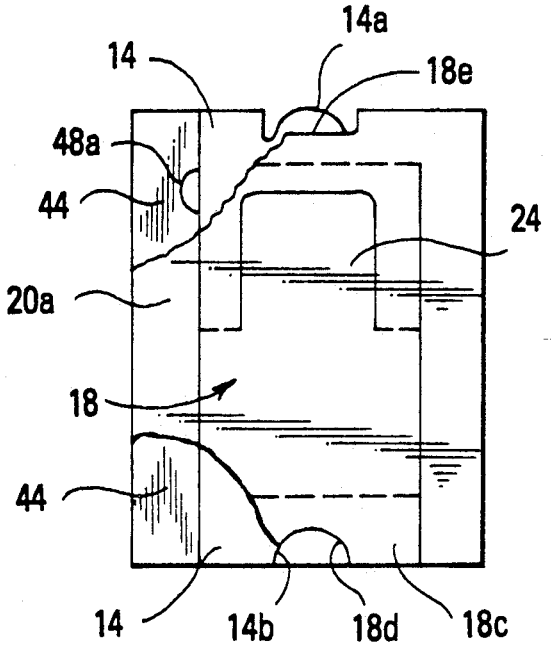
FIG. 6 is a perspective view of the finished device, showing the device in the rest or non-deployed (non-erected) state.

The finished product is shown in FIGS. 5 and 6, as well as FIG. 1, with parts of display portion 16 being broken away in FIG. 6 to show part of pull tab portion 14 under display portion 16 as well as a portion of part 44. As illustrated, pull tab portion 14 is captured between base portion 12 and display portion 16, and the pull tab **14*a* itself is exposed or presented between the mating notches or recesses 12*a* and 18*e* at the back end of the device 10 as viewed in FIG. 1. Pulling on tab 14*a* will cause movement of pull tab portion 14 in the groove or channel formed between guide rails 20*a* and 20*b* and, in particular, between parts 42 and 44. Such movement of the opposite end of pull tab portion 14 will, of course, cause like movement of foot portion 18*c* of the erectable portion 18 secured thereto. Such movement will also cause erectable portion 18 to fold along fold lines 22*a*, 22*b* and 22*c* so that portions 18*a* and 18*b* on opposite sides of central or intermediate fold lines 22*a* are caused to lift up from base portion 12 and form a tent-like configuration with the apex thereof along fold lines 22*a*, as described above and illustrated in FIG. 1. This causes pop-up portion 24 to separate on three sides from the remainder of erectable portion 18 and to extend upwardly and outwardly from portion 18*a* in the plane thereof. In the embodiment of FIG. 1, portion 24 is shaped to form the upper body of the action figure (pitcher) depicted, as is illustrated in FIG. 1. In this embodiment, tab 14*a* is pulled out until foot portion 18*c* is brought close to fold line 20*c* and thus the information ("TIPS") on tab portion 14 and the information ("RECORDS") on base portion 12** is revealed.

Although the present invention has been described relative to specific exemplary embodiments thereof, it will be understood by those skilled in the art that variations and modifications can be effected in these exemplary embodiments without departing from the scope and spirit of the invention.

What is claimed is:

1. A pop-up display device comprising a base member for supporting the device, an erectable display member, including an intermediate fold line between opposite ends thereof, movable between a first, rest position wherein said erectable display member lies flat over said base member and a second, deployed position wherein said erectable display member forms a tent-like construction formed by adjacent parts of the erectable display member joined at said fold line and with said intermediate fold line at the apex thereof, and an actuator member secured at one end thereof to said erectable display member for controlling movement of said erectable display member between said first and second positions, said erectable display member including a pop-up portion partially cut out from one of said adjacent parts so as to separate from the remainder of said erectable display member at said fold line and to extend outwardly from the other of said adjacent parts in a common plane therewith when said erectable display member is moved to the second position thereof.

2. A device as claimed in claim 1 further comprising a U-shaped portion which overlies and is secured to said base member and which includes central part and parallel legs connected to said central part and forming a channel between said legs, said erectable display member including a second fold line therein and being secured to said central part at said second fold line, and said parallel legs being disposed on opposite sides of said erectable display member so as to guide movement, in said channel, of said erectable display member between said first and second positions thereof.

3. A device as claimed in claim 2 wherein said actuator member comprises a flat strip which overlies said base portion and slides thereon and which extends laterally outwardly on at least one side thereof beneath one of said legs so as to retain said erectable display member in said channel.

4. A device as claimed in claim 3 wherein said erectable display member includes a foot portion which is joined to the remainder of the erectable display member at a third fold line and which lies flat on, and slides over, said base portion during movement of said erectable display member, said actuator member being secured to said foot portion of said erectable display member.

5. A device as claimed in claim 2, wherein said base member and said central part of said U-shaped portion include aligned notches forming a common recess in an outer edge of said device and said actuator member includes a pull tab which is disposed in said common recess so that access may be had to said pull tab when said erectable display actuator member is in the first, rest position thereof.

6. A device as claimed in claim 1 wherein said pop-up portion comprises at least a part of a human action figure depicted on said display member and said display device includes biographical data with respect to the human action figure depicted.

7. A pop-up display device comprising a flat base portion defining a plane forming a support for the device; an erectable display portion having ends and disposed in a non-erected state so as to overlie said base portion and including a transverse fold line located intermediate the ends thereof, a pop-up portion partially cut out from said erectable display portion, and a pull tab member disposed between said erectable display portion and said base portion, said pull tab member including a pull tab located at one end of the pull tab member and said pull tab member being secured to said erectable display portion such that a pulling force exerted on said pull tab will cause said erectable display portion to be elevated from the plane of said base portion at said fold line and to cause said pop-up portion to be erected so as to extend outwardly from the remainder of said erectable display portion adjacent to said fold line.

8. A device as claimed in claim 7 wherein said base portion includes lateral edges and said device further comprises a U-shaped portion including a central part and a pair of legs which overlie and extend along the lateral edges of said base portion so as to form a channel therebetween, said erectable display member being secured to said central part along a further transverse fold line and being disposed in said channel between said legs.

9. A device as claimed in claim 8 wherein said erectable display portion comprises a foot portion located at one end thereof opposite said further fold line and secured to the remainder of said erectable display portion member at another transverse fold line.

10. A device as claimed in claim 9 wherein said foot portion of said erectable display portion includes an underside and said pull tab member is secured, at the end thereof opposite to said pull tab, to the underside of said foot portion of said erectable display portion and includes at least one lateral portion which underlies one of said legs so as to retain said erectable display portion within said channel.

11. A device as claimed in claim 8 wherein said central part and said base member include notches, in aligned edges thereof, in registration with each other so as to form a common recess, and wherein said pull tab is located in said common recess when said erectable display portion is in said non-erected state.

12. A blank for forming a pop-up display device, said blank comprising a first, central section and second and third lateral sections formed by first and second fold lines between said central section and said second section and between said central section and said third section, respectively, said central section forming a flat base of said display device when the display device is assembled, one of second and third sections including an erectable display member including a pop-up portion partially cut out therefrom and being folded over, in the assembly of said display device, along one of said fold lines to overlie said flat base, and the other of said sections including an actuator member and having cuts therein so that the actuator member is readily separable from said blank, and being disposed, when the display device is assembled, between said one section and said flat base with said actuator member secured to said erectable display member.

13. A device as claimed in claim 12 wherein said erectable display member of said one section is disposed between lateral portions of said one section and is separated therefrom by cuts in said blank, and is joined at a first, transverse fold line to an end portion of said one section, said pop-up portion of said erectable display member including a base part joined to the remainder of said erectable display member adjacent to a second, intermediate, transverse fold line.

14. A device as claimed in claim 13 wherein said erectable section includes a third transverse fold line spaced from intermediate fold line on the opposite side thereof from said first fold line.

15. A device as claimed in claim 13 wherein said actuator member is wider than said erectable display member.

16. A device as claimed in claim 12 wherein said other section includes an outer elongate strip separated from said actuator member by a longitudinal cut in said other section and adapted to be separated completely therefrom so as to be secured to one side of said base, and a further elongate portion which is disposed adjacent to the fold line joining said other section to said central section and adapted to be folded over said base along said joining fold line and secured to the opposite side of said base from said one side.

17. A device as claimed in claim 12 wherein said central section and said one section include notches therein which are brought into registration to form a common recess in an edge of the display device when said one section is folded over to overlie said central section.

18. A device as claimed in claim 17 wherein said actuator member includes a pull tab formed in one end thereof which, when the display device is assembled, is disposed in said common recess.

19. A device as claimed in claim 12 wherein said actuator member and said erectable display member include notches therein which are brought into registration when said actuator member is secured to said erectable display member.

20. A device as claimed in claim 12 wherein said pop-up portion comprises part of a human action figure depicted on said one section, and at least one of said sections having displayed thereon biographical material relating to the human action figure.

* * * * *